US007117650B2

(12) United States Patent
Dockery

(10) Patent No.: US 7,117,650 B2
(45) Date of Patent: Oct. 10, 2006

(54) HANGER SYSTEM

(76) Inventor: Forrest Dockery, 561 Green Mountain St., Simi Valley, CA (US) 93065

( * ) Notice: Subject to any disclaimer, the term of this patent is extended or adjusted under 35 U.S.C. 154(b) by 342 days.

(21) Appl. No.: 10/731,313

(22) Filed: Dec. 9, 2003

(65) Prior Publication Data

US 2004/0111995 A1 Jun. 17, 2004

Related U.S. Application Data

(60) Provisional application No. 60/455,842, filed on Mar. 18, 2003, provisional application No. 60/432,094, filed on Dec. 9, 2002.

(51) Int. Cl.
*E04B 2/00* (2006.01)

(52) U.S. Cl. ..... 52/506.07; 52/506.05; 52/506.08; 248/302; 248/327; 248/343

(58) Field of Classification Search ..... 52/506.05, 52/506.07, 506.08, 506.06; 248/302, 327, 248/343, 58, 304, 916
See application file for complete search history.

(56) References Cited

U.S. PATENT DOCUMENTS

| | | | | |
|---|---|---|---|---|
| 104,622 | A | 6/1870 | Merlett | |
| 882,937 | A | 3/1908 | Fegley | |
| 2,910,738 | A * | 11/1959 | McCorkell | 52/506.06 |
| 3,127,147 | A * | 3/1964 | Sprangenberg | 248/327 |
| 3,207,057 | A * | 9/1965 | Brown et al. | 454/301 |
| 4,502,192 | A | 3/1985 | Hess | |
| 4,524,495 | A | 6/1985 | Hess | |
| 4,557,446 | A | 12/1985 | Barron | |
| 4,684,050 | A | 8/1987 | Masas | |
| 4,706,380 | A | 11/1987 | Fall | |
| 4,713,864 | A | 12/1987 | Hess | |
| 4,744,171 | A | 5/1988 | Hilliard | |
| 4,791,969 | A | 12/1988 | Cinque | |
| 4,979,715 | A | 12/1990 | Rancourt | |
| 5,012,624 | A | 5/1991 | Dahlgren | |
| 5,363,525 | A | 11/1994 | Andreasen | |
| 5,364,053 | A * | 11/1994 | Rodgers | 248/302 |
| 5,507,209 | A | 4/1996 | Allen et al. | |
| 5,664,754 | A | 9/1997 | Gaenslen | |
| 6,205,733 | B1 * | 3/2001 | LaLonde | 52/506.07 |
| 6,253,314 | B1 * | 6/2001 | Itoh | 712/226 |
| 6,840,021 | B1 * | 1/2005 | Ashmore et al. | 52/733.1 |
| 6,945,501 | B1 * | 9/2005 | Thompson | 248/58 |

FOREIGN PATENT DOCUMENTS

| | | |
|---|---|---|
| DE | 806 004 | 6/1951 |

* cited by examiner

*Primary Examiner*—Carl D. Friedman
*Assistant Examiner*—Yvonne M. Horton
(74) *Attorney, Agent, or Firm*—Gifford, Krass, Groh, Sprinkle, Anderson & Citkowski, p.c.

(57) ABSTRACT

An improved ceiling hanger system includes an anchor that is secured to a support structure. A hanger wire is mounted to the anchor. A spring clip is mounted to the hanger wire. A hanger hook is mounted to or integral with the spring clip and engages a support rail for a drop or suspended ceiling.

19 Claims, 5 Drawing Sheets

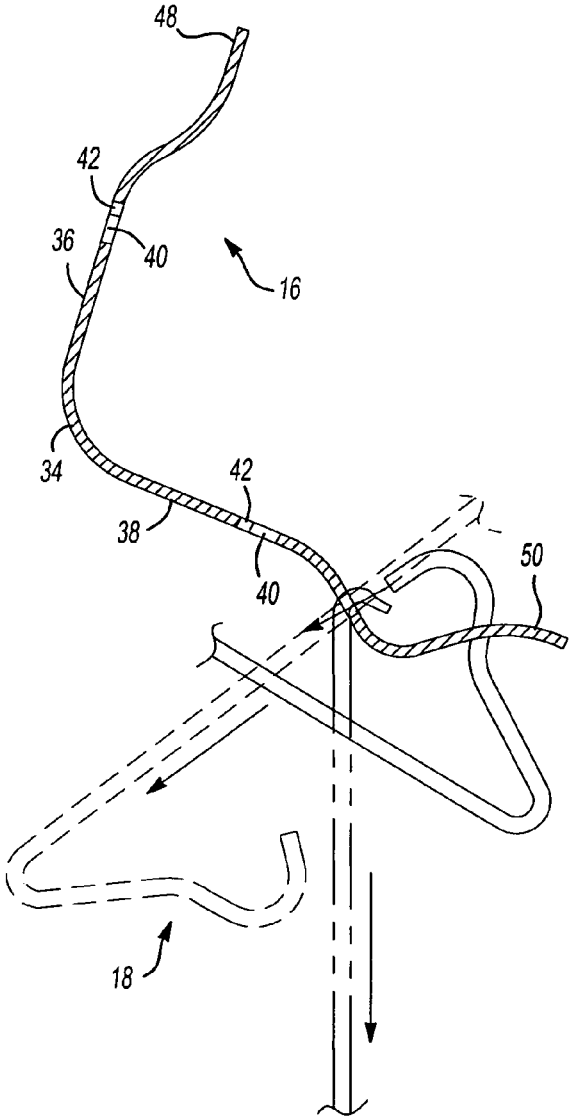
Fig-13
Fig-14
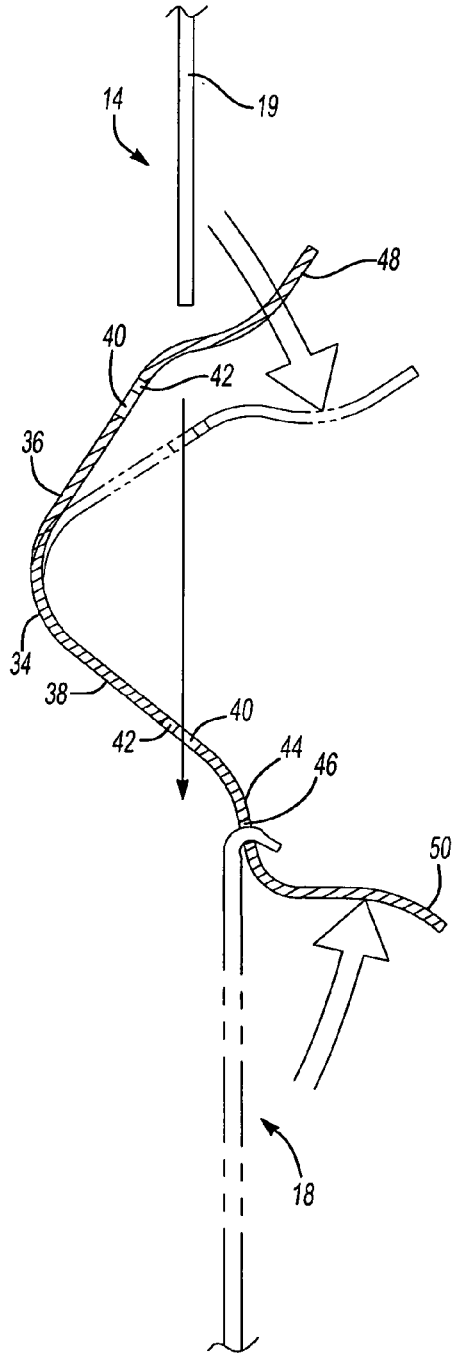

HANGER SYSTEM

CROSS-REFERENCE TO RELATED APPLICATIONS

This application claims priority from U.S. Provisional Patent Application No. 60/432,094 filed on Dec. 9, 2002 for a Hanger System and also from U.S. Provisional Patent Application No. 60/455,842 filed on Mar. 18, 2003 for a Ceiling Hanger System.

BACKGROUND OF THE INVENTION

1. Field of the Invention

The present invention concerns a hanger system for use in supporting a suspended or drop ceiling. More specifically, the invention concerns an apparatus adapted to engage and adjustably support a ceiling rail.

2. Reference to Related Art

Suspended or drop ceilings are found in office buildings and homes throughout the country and around the world. Such ceilings typically include a plurality of tiles that are supported by a grid of support rails. The rails are themselves supported by a plurality of hanger wires that are affixed at one end to anchors that are secured in an overhead support structure (e.g., the building frame, masonry, ceiling, etc.). An opposite end of each wire is mounted to a support rail. Specifically, the opposite end of each hanger wire is threaded through apertures in the support rail and then wrapped or twisted at least three times (by hand) back around the body of the hanger wire. This wrapping (or twisting) step is performed to ensure that the support structure (rails, wires, etc.) for the ceiling will conform to existing ICBO (now ICC—International Code Council)(see also UCB and ASTM) code standards. The wrapping of the hanger wire also allows the wire to swivel and such that it may conform to any direction that it wishes to assume. This type of prior art system is clearly shown in U.S. Pat. Nos. 5,012,624 and 5,363,525.

An alternative to the traditional hanger system is shown in U.S. Pat. Nos. 4,979,715 and 5,364,053. In each of these references, a loop is formed on the free end of the hanger wire. An anchor, such as a flat head screw, is passed through the loop and secured to the overhead support structure. The head of the screw has a diameter that is larger than the diameter of the loop such that the head of the screw serves to support the suspended hanger wire.

In addition to the above-discussed hanger systems, the prior art also discloses a variety of fastener systems. One known type of fastener system is the T-slot fastener. This type of fastener, which typically uses a T-shaped male head portion and a slotted female portion, is shown in U.S. Pat. Nos. 4,502,192 and 4,524,495. A variation on the T-slot fastener system is shown in U.S. Pat. No. 4,744,171, which discloses a hanging pot suspension system.

After a grid or network of support rails is installed, ceiling panels are placed into the grid to complete the ceiling.

The existing method of wrapping each wire back around itself is obviously labor intensive. Not only is the installer of the ceiling required to wrap the hanger wire around itself at least three times, he or she is also often required to make fine adjustments in the height of the grid after all the hanger wires are in place. Naturally, a process of wrapping and unwrapping a hanger wire (or more particularly a series of hanger wires) to make fine adjustments to the height of a grid of support rails only increases the amount of labor (and cost) involved in any ceiling installation operation.

Therefore, it would be advantageous to have a ceiling hanger system that not only dispenses with the need to wrap the wire back around itself, but also allows the user to quickly and accurately make fine adjustments to the system once in place.

SUMMARY OF THE INVENTION

The present invention permits a user to quickly and easily install a railing structure for a suspended or drop ceiling. The ceiling hanger system includes an anchor that is secured to a support structure. A hanger wire having a head is mounted to the anchor. A spring clip is moveably (adjustably) mounted to the hanger wire. Finally, a hanger hook is mounted to (or integral with) the spring clip and engages a support rail for a drop or suspended ceiling.

The design of the head of the hanger wire allows for quick installation of the hanger wire relative to the prior art method of wrapping the wire around itself. Furthermore, the spring clip allows for easy adjustment of the height of a rail through repositioning of the spring clip along the hanger wire.

BRIEF DESCRIPTION OF THE DRAWINGS

A better understanding of the present invention will be had upon reference to the attached figures, wherein like reference numerals refer to like parts throughout, and wherein:

FIGS. 13 are side views showing engagement of the hanger hook with the spring clip of the present invention;

FIG. 14 is a side views showing engagement of the hanger hook and hanger wire with the spring clip of the present invention;

DETAILED DESCRIPTION

Figure 1:
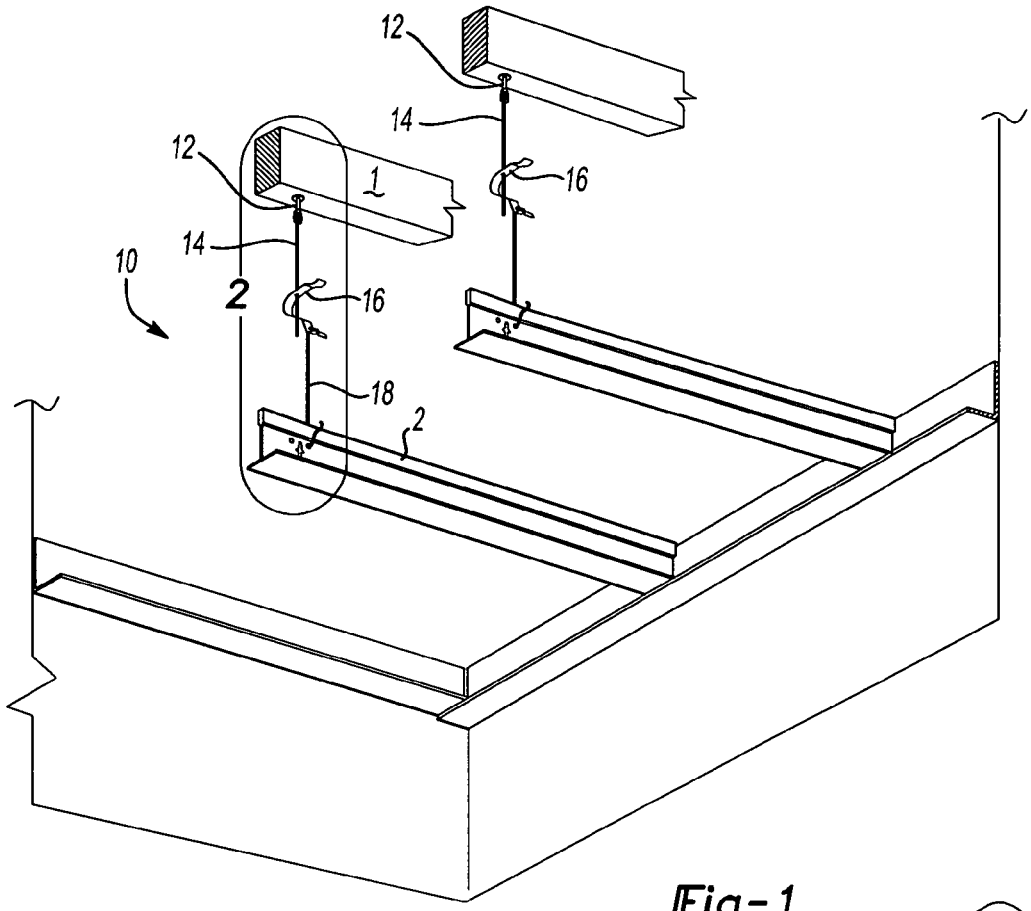
FIG. 1 is a perspective environmental view of an improved ceiling hanger system constructed in accordance with a preferred embodiment of the present invention.
Figure 2:
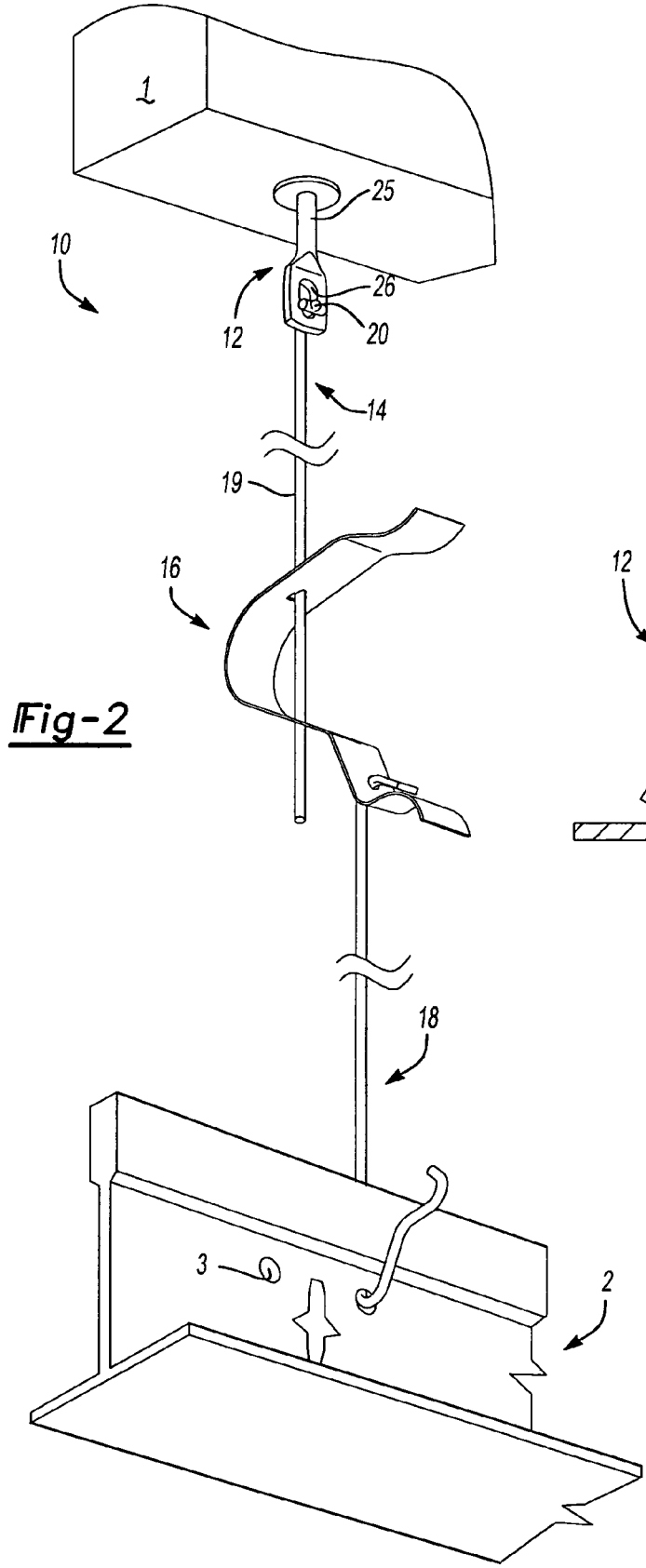
FIG. 2 is a perspective view of the improved ceiling hanger system of the type shown in FIG. 1.

Referring now to FIGS. 1–2, an improved ceiling hanger system 10 includes an anchor 12 secured to a support structure 1, a hanger wire 14 mounted to the anchor 12, a spring clip 16 mounted to the hanger wire 14 and a hanger hook 18 mounted to the spring clip 16. The hanger hook 18 engages a support rail 2 for a drop or suspended ceiling (not shown). The support structure 1 may be any manner of substrate such as a wood frame, masonry, stone, sheetrock, etc. In addition to the description provided herein, the invention including the anchor 12, hanger wire 14, spring clip 16 and hanger hook 18 are also described in U.S. Provisional Patent Application No. 60/432,094 filed on Dec. 9, 2002 for a Hanger System and U.S. Provisional Patent Application No. 60/455,842 filed on Mar. 18, 2003 for a Ceiling Hanger System, the disclosures of which are each incorporated herein by reference.

Still referring to FIGS. 1–2, the hanger wire 14 has a body 19 (or trailing portion) and a head 20 formed at one end 22 of the body 19. The hanger wire 14 is constructed from 12 (0.106-inch diameter 1008 steel) or 8 gauge steel ceiling wire with the head 20 being formed by cold forming or heading. However, this construction recitation is not intended to limit the scope of the invention and it will be appreciated that other materials, gauges of wire or head fabrication methods that have the requisite strength characteristics also be used to construct the hanger wire 14.

Still referring to FIGS. 1 and 2, the body 19 of the hanger wire 14 is bent at an angle between 0° and 90°; preferably proximate the one end 22 such that the head 20 is angled relative to the body 19. As will be described below, the bend in the body 19 of the hanger wire 14 assists in the installation by restricting the ability of the hanger 14 wire to separate from the anchor 12.

Figure 9:
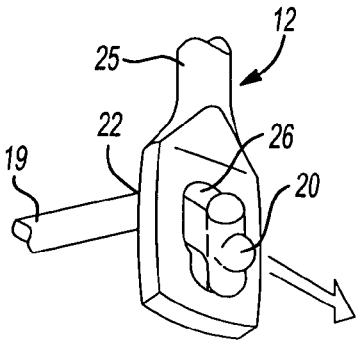
FIGS. 9–10 are perspective view showing engagement of a hanger wire of the present invention with a support surface anchor.
Figure 10:
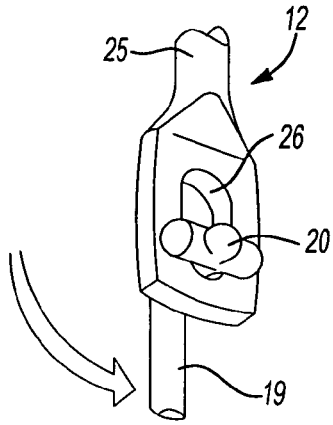
Figure 11:
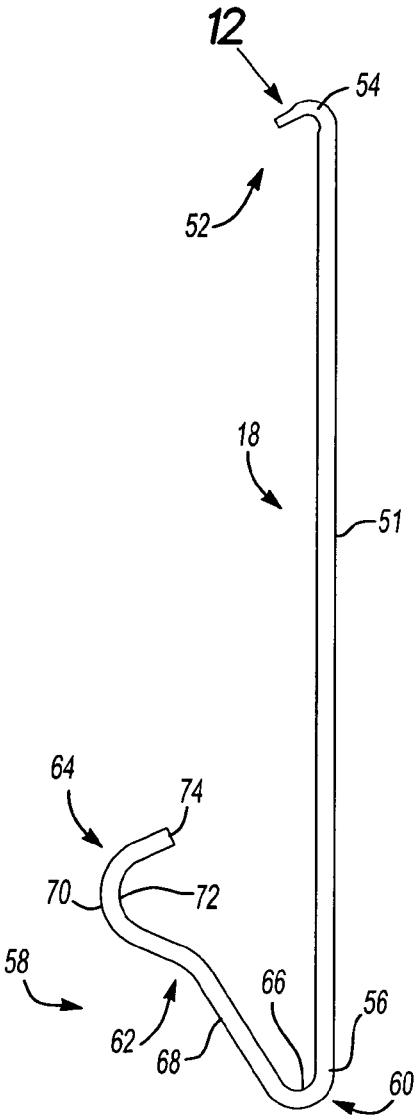
FIG. 11 is a side view of a hanger hook for use in connection with the present invention.
Figure 15:
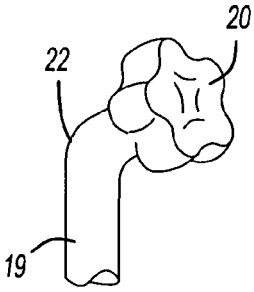
FIGS. 15–18 are perspective views of head portions of the hanger wire of the present invention.
Figure 16:
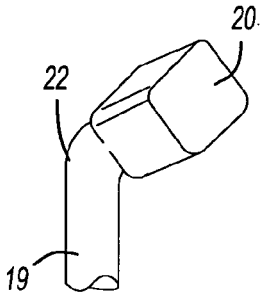
Figure 17:
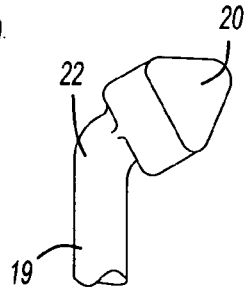
Figure 18:
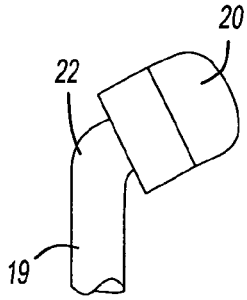

Referring now to FIGS. 2, 9 and 10, the head 20 of the hanger wire 14 has a male "T" shape. However, the head 20 is not limited to the shape shown in FIG. 2 and it will be appreciated that the head may be constructed in other shapes. Examples of other shapes for the head 20 include a rosette (FIG. 15), a square (FIG. 16), a triangle (FIG. 17), a D form (FIG. 18) or equivalents thereof as well as other configurations or designs.

Figure 3:
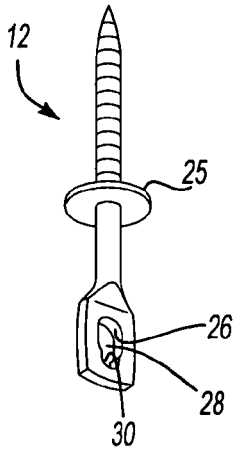
FIGS. 3–8 are perspective views of support surface anchors for use in connection with the present invention.
Figure 4:
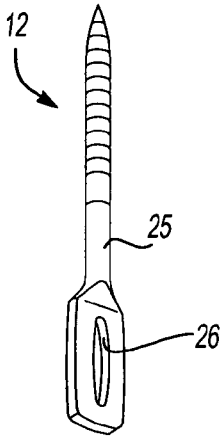
Figure 5:
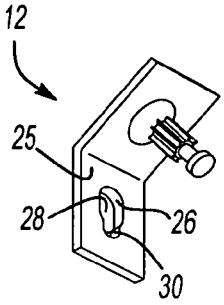
Figure 6:
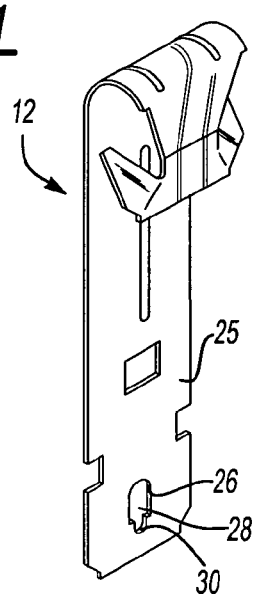
Figure 7:
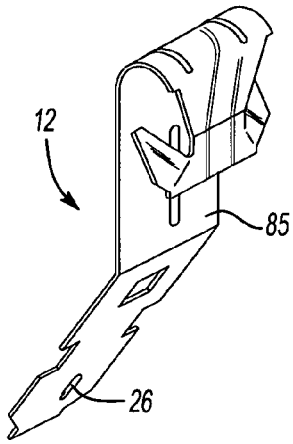
Figure 8:
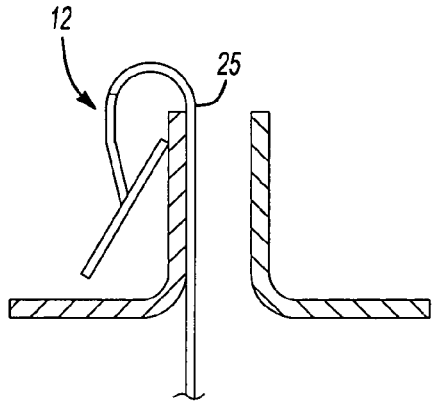

As best shown in FIG. 2, the anchor 12 includes a body 25, having an opening 26 defined therein. As shown is FIG. 2–3, the anchor is a headed eye lag screw. However, other devices may also be used as the anchor 12 of the present invention. Examples of other anchors 12 include: a standard eye lag wood screw (FIG. 4); an angel clip (FIG. 5); a c-pearlin or bar joist clip (FIG. 6); a Z-perlin clip (FIG. 7); or equivalents thereof as well as other configurations or designs that are securable to a support structure 1.

Referring to FIGS. 2–10 and a best shown in FIGS. 9–10, the opening 26 (or eye) of the anchor 12 is dimensioned to accept the head 20 of the hanger wire 14 when the head 20 is positioned in a first orientation (see e.g., FIG. 9). For example, as shown in FIGS. 2, 3, 5–7 and 9–10, the opening 26 has a "keyhole" shape that has an upper portion 28 and a lower portion 30; the width of the lower portion 30 being less than the width of the upper portion 28.

Still referring to FIGS. 9, 10, in mounting the hanger wire 14 to the anchor 12, the head 20 of the hanger wire 14 is placed in a first orientation (FIG. 9) that permits passage of the head 20 through the opening 26 of the anchor 12. Once the head 20 of the hanger wire 14 has passed through the opening 26 (while in the first orientation) head 20 of the hanger wire 14 is rotated into a second orientation (FIG. 10) that does not allow passage of the head 20 back though the opening 26. Therefore, once the head 20 is placed in the second orientation, the hanger wire 14 is prevented from dismounting from the anchor 12 as a result of the head 20 sliding or otherwise passing back through the opening 14 of the anchor 12.

In the embodiment shown in FIG. 10, the "keyhole" shaped opening 26 is used and the hanger wire 14 is bent at an angle proximate the one end 22 of the body 19, preferably near the head 20. Once the head 20 is passed through the upper portion 28 in the first orientation (FIG. 9) gravity operates to position the hanger wire 14 into a second orientation and also urges a portion of the body 24 of the hanger wire 14 proximate the head 20 into the lower portion 30 of the opening 26. Alternatively, where the hanger wire 14 is not constructed with a bend proximate the head portion 24 (or no bend whatsoever), the head 24 may be passed through the opening 26 in a first orientation. Once the head 20 is properly oriented, the body 19 of the hanger wire 14 may then be manually bent to an angle between 0 and 90 degrees.

Figure 12:
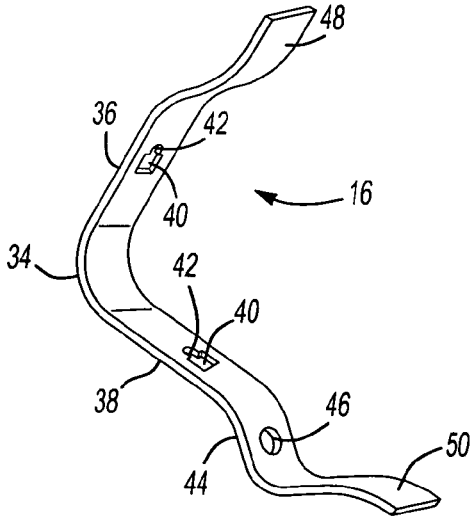
FIG. 12 is a perspective view of a spring clip for use in connection with the present invention.

Referring now to FIGS. 1, 2 and 12, there is shown a spring clip 16. The spring clip 16 has a resilient generally V-shaped body 34 with top 36 and bottom 38 engagement portions. The top 36 and bottom 38 engagement portions each include an aperture 40 having a notch 42; the apertures 40, and specifically the notches 42, being adapted to engage the hanger wire 14 as will be described hereinbelow. The bottom engagement portion 38 has hook support portion 44 with a support aperture 46 defined therein. The top 36 and bottom 38 engagement portions each terminates with a compression flange 48, 50.

In operation, a user will grasp each compression flange 48, 50 of the spring clip 16 and apply pressure to draw the flanges 48, 50 together. The body 19 of the hanger wire 14 is then threaded through the apertures 40 and the notches 42 of the apertures 40 engage the wire 14 following the release of the compression flanges 48, 50 and the resilient return of the body 34 of the spring clip 16 to an uncompress configuration. In a particular preferred embodiment, each aperture 40 has a length of 2.83 mm with the notch 42 of each aperture having a length of 2.1 mm and a width of 1.88 mm (the width of the notch 42 being less than the width of the aperture 40. The inventor has found that each notched 42 aperture 40 on the body 34 of the spring clip 16 applies a holding force sufficient to support a load of between 200–220 lbs. Therefore, it will be appreciated that the pair of apertures 40 supply a combined holding force sufficient to support a load of at least 400 lbs.

Referring now to FIGS. 1, 2, 11, 13–14, the hanger hook 18 has a body 51 and is constructed of spring steel (or alternatively 1044 to 1060 steel) and includes at a first end 52 a support hook 54 and at an opposite end 56 a double hook 58. The support hook 54 engages the support aperture 46 of the spring clip 16 such that the support hook 54 is mounted to (suspended from) the spring clip 16. Additionally, or alternatively, once the support hook 54 has engaged the support aperture 46, it may be crimped or otherwise secured to the support portion 44. Furthermore, as an alternative to the double hook 58 a conventional hook may also be used on the opposite end 56 of the hanger hook 18.

Referring now to FIGS. 1, 2, 11, 13–14, the double hook 58 of the hanger hook 20 is adapted to engage an aperture 3 of the support rail 2 to thereby support the rail 2. The double hook 58 of the hanger hook 14 includes a first 60 a second 62 and a third 64 curved portion. The first curve 60 is formed by bending an opposite end 56 of the support hook 18 approximately 180° such that the opposite end 56 takes on a first general U shape 66 formed by the body 51 of the hanger hook 14 and an upwardly extending portion 68. The upwardly extending portion 68 is then bent (to form the second curved portion 62) at a first predetermined point at an angle between 0° and 90° away from body 51 of the hanger hook 18 and then 180° back toward the body 51 (to form the third curved portion 64) at a second predetermined point to form a second general U-shape 70 that is perpendicular to and in the same plane as the first U-shape 66. The distance between the body 51 and the upwardly extending portion 68 in the first general U-shape 66 is between 5 and 12 mm and is preferably 8.5 mm. The distance between the body 51 and a base 72 of the second general U shape 70 is between 15 and 20 mm and is preferably 18.6 mm. The distance between the opposite end 74 of the hanger hook 18 and the body 51 of the hanger hook 14 is between 3 and 10 mm and is preferably 8.7 mm. Finally, the body 51 of the hanger hook 18 has a preferred length of 40 mm.

Still referring to FIGS. 1, 2, 11, 13–14, in operation the double hook 58 of the hanger hook 18 engages one of the plurality of apertures 3 in a rail 2. However, this engagement operation can, preferably, only be performed when the hanger hook 18 is in a first inverted orientation. Once the opposite end 74 of the hanger hook 18 is threaded into the aperture 3 of the rail 2, the entire hook 18 is rotated such that it obtains a second upright orientation. Accordingly, the hanger hook 18 cannot be removed or otherwise dismounted from a rail 2 unless the hanger hook 18 is rotated back into the first inverted orientation.

Referring now to FIGS. 1–2, the present invention permits a user to quickly and easily install a railing structure for a suspended or drop ceiling. Specifically, the head of the hanger wire 16 allows for faster installation of the hanger wire relative to the prior art method of wrapping the wire around itself. Furthermore, use of the spring clip 16 allows for easy adjustment of the height of a rail 2 through repositioning of the spring clip 16 along the body 19 of the hanger wire 14.

Figure 19:
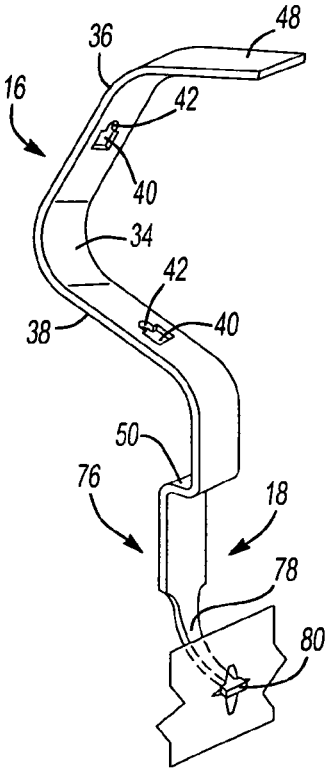
FIG. 19 is a partial environmental perspective view of a spring clip with an integral hanger hook constructed in accordance with the present invention.
Figure 20:
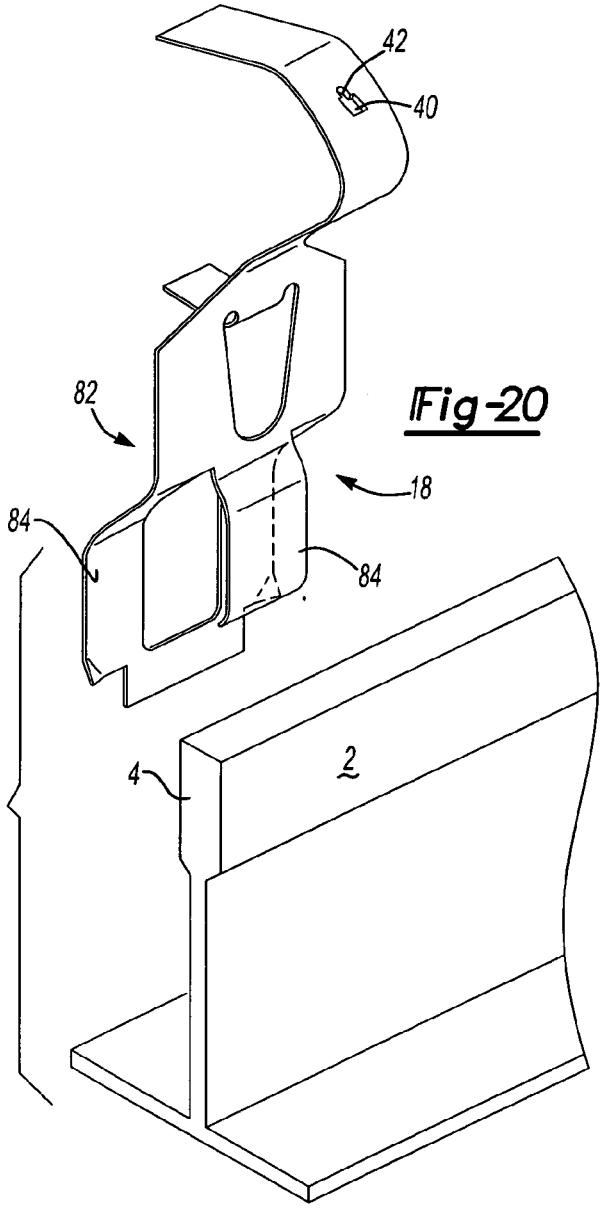
FIG. 20 is a perspective environmental view of a spring clip with an integral alternative construction for a hanger hook.

Referring now to FIGS. 19 and 20, there is shown a first 100 and second 200 alternative embodiment for the hanger system of the present invention. Each alternative embodiment 100, 200 includes an anchor 12 (not shown) secured to a support structure 1 (not shown), a hanger wire 14 mounted to the anchor 12 (not shown), a spring clip 16 mounted to the hanger wire 14 and a hanger hook 18 mounted to the spring clip 16 that engages a support rail 2 for a drop or suspended ceiling (not shown).

Referring now to FIG. 19, in the first alternative embodiment 100 the hanger hook 18 is constructed integral with the spring clip 16 and includes a body 76 that extends from the compression flange 50 of the bottom engagement portion 38. A curved portion 78 extends from the body 76 and terminates with a head 80. As with the head of the wire hanger 14, the head 80 of the hanger hook has a "T" shape that may be passed through an aperture 3 in the rail 2 when in a first orientation. However, once placed in a second orientation the head 80 of the hanger hook 18 may not be passed back through the aperture 3.

Referring now to FIG. 20, in the second alternative embodiment the hanger hook 18 is again constructed integral with the spring clip 16 and includes a body 82 that extends from the bottom engagement portion 38 of the spring clip 16. The body 82 includes a pair of opposed clamp arms 84 that are adapted to engage a cross bar 4 of a rail 2.

Having thus described my invention, various other embodiments will become apparent to those having skill in the art that do not depart from the scope of the present invention. Furthermore, although particular preferred embodiments of the invention have been recited in the above description, it is not the inventor's intention to restrict the claims of the present invention only to those recited embodiments.

The invention claimed is:

1. A ceiling hanger system comprising:
an anchor having a body defining an opening;
a hanger wire mounted to the anchor;
a spring clip mounted to the hanger wire; and
a hanger hook mounted to the spring clip.

2. The ceiling hanger system of claim 1, wherein the hanger wire comprises a body having a first end and a second end and a head positioned on the first end.

3. The ceiling hanger system of claim 2, wherein the head of the hanger wire has a T-shape.

4. The ceiling hanger system of claim 2, wherein the head of the hanger wire has a shape selected from the group consisting of: a T-shape, a rosette, a square, triangle and a D-form.

5. The ceiling hanger system of claim 2, wherein the body of the hanger wire is bent at an angle between 0° and 90°.

6. The ceiling hanger system of claim 1, wherein the opening defined in the body has an upper portion and a lower portion.

7. The ceiling hanger system of claim 6, wherein the upper portion has a width that is greater than the width of the lower portion.

8. The ceiling hanger system of claim 1, wherein the anchor comprises a lag screw.

9. The ceiling hanger system of claim 1, wherein the anchor is selected from the group consisting of: a headed eye lag screw, a standard eye lag wood screw, an angel clip, a c-pearlin, clip, a bar joist clip and a Z-perlin clip.

10. The ceiling hanger system of claim 1, wherein the spring clip includes a resilient body having a first and second aperture defined therein, the first and second aperture each having a notch.

11. The ceiling hanger system of claim 1, wherein the hanger hook has a first end and a second end, the first end having a support hook operable to engage the spring clip, the second end having a double hook.

12. The ceiling hanger system of claim 11, wherein the double hook includes a first curved portion, a second curved portion and a third curved portion.

13. The ceiling hanger system of claim 1, wherein the hanger hook comprises a body having a curved portion including a head.

14. The ceiling hanger system of claim 1, wherein the hanger hook includes a body having a pair of opposed clamp arms.

15. A ceiling hanger system comprising:
an anchor having a body defining an opening;
a hanger wire mounted to the anchor, the hanger wire comprising a body having a head;
a clip mounted to the hanger wire; and
a hanger hook mounted to the clip.

16. The ceiling hanger system of claims 15, wherein the head of the hanger wire has a T-shape.

17. The ceiling hanger system of claim 15, wherein the clip includes a resilient body having an aperture defined therein, the aperture having a notch.

18. A ceiling hanger system comprising:
an anchor;
a hanger wire mounted to the anchor, the hanger wire including a body having a head; and
a spring clip mounted to the hanger wire, the spring clip having a resilient body including an aperture defined therein, the aperture having a notch.

19. A ceiling hanger system comprising:
an anchor;
a hanger wire mounted to the anchor, the hanger wire including body having a first end and a second end and a head positioned on the first end, the head of the hanger wire has a T-shape;
a clip mounted to the hanger wire; and
a hanger hook mounted to the clip.

* * * * *